US006141943A

United States Patent [19]

Hart et al.

[11] Patent Number: 6,141,943

[45] Date of Patent: Nov. 7, 2000

[54] FOOD ARTICLE LOADING HEAD AND METHOD

[75] Inventors: Colin R. Hart; Gregg A. Martin, both of Charlottesville; Jimmy L. Meyer, Waynesboro; James A. Thompson, Stuarts Draft, all of Va.

[73] Assignee: F. R. Drake Company, Waynesboro, Va.

[21] Appl. No.: 09/157,522

[22] Filed: Sep. 21, 1998

[51] Int. Cl.[7] ..... B65B 19/34

[52] U.S. Cl. ..... 53/444; 53/475; 53/148; 53/537; 53/236; 53/246; 53/251; 198/418.6; 198/614

[58] Field of Search ..... 53/443–444, 448, 53/475, 148, 152, 153, 531, 537, 539, 236, 244, 246, 251, 252; 198/347.3, 418.6, 426, 429, 614

[56] References Cited

U.S. PATENT DOCUMENTS

| | | | |
|---|---|---|---|
| 4,386,490 | 6/1983 | Griffith et al. | 53/148 |
| 4,750,607 | 6/1988 | Focke | 198/792 |
| 5,060,454 | 10/1991 | Benz | 53/444 |
| 5,117,614 | 6/1992 | Johnsen | 53/540 |
| 5,232,080 | 8/1993 | van Essen et al. | 198/418.6 |
| 5,325,653 | 7/1994 | Boyd | 53/248 |
| 5,371,995 | 12/1994 | Guttinger et al. | 53/251 |
| 5,388,385 | 2/1995 | Phelps et al. | 53/247 |
| 5,560,179 | 10/1996 | Leifeld | 53/118 |
| 5,720,149 | 2/1998 | Stimpfl | 53/244 |

*Primary Examiner*—Ed Tolan

*Attorney, Agent, or Firm*—Liniak, Berenato, Longacre & White, LLC

[57] ABSTRACT

A loading head for loading food articles into packaging includes a transfer conveyor in operable communication with a source of articles to be loaded. The transfer conveyor communicates the articles from an upper receiving position to a lower loading position. A first drive drives the transfer conveyor at a variable speed. A second drive oscillates the transfer conveyor between a first position and a second position. A controller is in operable association with the first and second drives for varying the driving speed of the transfer conveyor as a function of the position of the transfer conveyor. An article holder is disposed at the loading position for receipt of a transferred article.

42 Claims, 11 Drawing Sheets

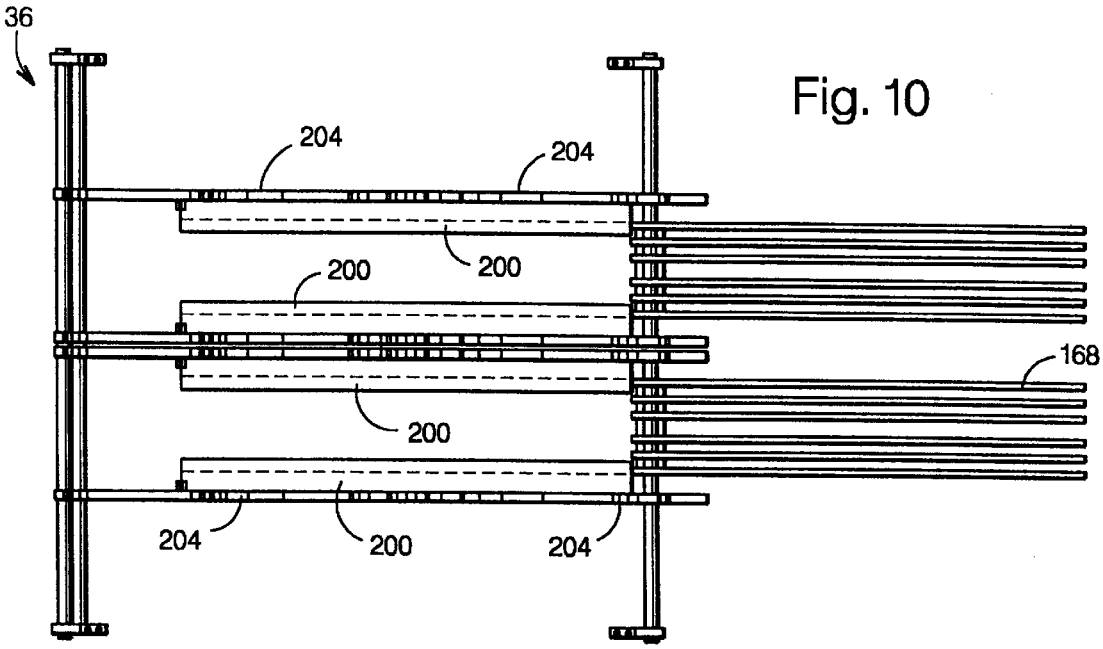
Fig. 10
Fig. 9
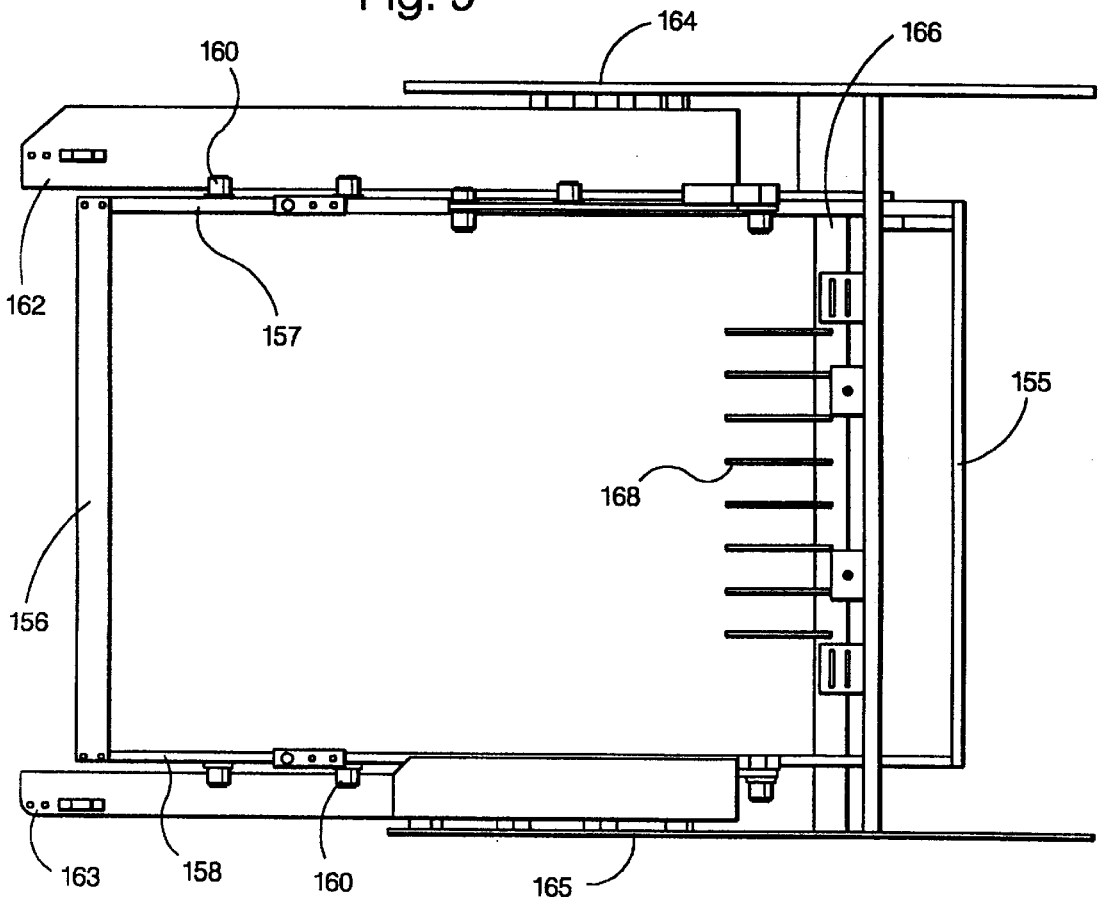

FOOD ARTICLE LOADING HEAD AND METHOD

FIELD OF THE INVENTION

The disclosed invention is a loading head for loading food articles such as franks or other similarly shaped food articles into packaging. More particularly, the invention is a loading head creating a variable accumulation between when the food articles are grouped into sets and when they are deposited into the packaging. The variable accumulation increases the rate at which the food products may be loaded into the packaging. The invention permits food articles to be supplied to the loading head at a constant rate, while also permitting the food articles to be transferred to the packing at a variable rate. Moreover, they may be stripped or transferred into the packaging at a uniform speed and through application of uniform force.

BACKGROUND OF THE INVENTION

Hot dogs or franks, sausages, hamburgers, chicken patties, and other food products typically are prepared by a manufacturer on one piece of equipment, and then loaded into an indexing type packaging machine with a separate loading machine. The food products frequently are oriented and aligned by the loading machine in a side by side configuration. In the past, loading machines have included loading heads which load food articles, such as hot dogs, into packaging trays positioned beneath the loading head. The loading head can be configured to group food articles into sets and load multiple packages at one time, and can accommodate packages of varying size and arrangement.

The rate at which food products may be packaged has been increasing. It is desirable that the speed at which the food articles are loaded be substantially equal to the speed at which the food articles can be packaged. There has been difficulty in developing a loading head operable at loading speeds comparable to the rate at which the food articles are capable of being packaged, however.

A loading head may include a sweeper device rotating one revolution per product group, to extract a group or set having a predetermined number of individual products from the loading machine and place the group onto a transfer conveyor traveling at a constant rate. This process continues until a predetermined number of product groups have been accumulated under an overhead stripper device. The stripper device discharges the product groups with an intermittent motion into the packages. The stripper device transfers the grouped food products from beneath the transfer conveyor into cavities of the packaging machine. The food products preferably are positioned over the cavities prior to operation of the stripper device.

The current industry loading head is limited in the number of pieces per minute it can process, in part by the cycle time of the stripper device. The stripper device operates during a time when the sweeper device is not transferring food products onto the transfer conveyor. As the food product group count becomes smaller, or the number of product groups per index of the packaging machine increases, then the time available for the strip cycle is reduced.

Thus, there is a need in the art for a loading head that loads food products into an indexing type packaging machine at a stripper device rate that is independent of the sweeper device rate. There is also a need for a stripper device that operates at a rate that is independent of the rate at which food products are supplied to the loading head.

In addition, the driving mechanisms of the stripper device and the sweeper device are typically coordinated, so that the speed of the sweeper device is directly related to rate at which the food products are being stripped. If food products become jammed in the sweeper device or other parts of the loading head, the packaging machine must be slowed while the problem is resolved. Slowing the packaging machine results in decreasing the speed at which the food products are being stripped. The speed and force with which the food products are stripped is important. The optimal strip rate is attained when the loading head is run at fill speed. As the rate is changed, the strip characteristics are changed, sometimes causing malfunctions.

Thus, there is a need in the art for a stripping device on a loading head that may operate independently of the overall operation rate of the loading head.

The disclosed invention achieves these needs and others by providing a loading head that creates a variable accumulation between the sweeper device and the stripper device, thereby allowing the stripper device cycle time to be independent of the sweeper device cycle time. In addition, a dedicated drive is provided for operating the stripper device, so that an optimum strip rate may be attained, even when the speed of the loading head is reduced. In addition, the invention permits the exit side of the transfer conveyor to have a position of zero relative speed, while the input side has a non-zero speed in order to permit food products to be supplied at a constant rate.

SUMMARY OF TIE INVENTION

A loading head for loading food articles comprises a transfer conveyor in operable communication with a source of articles to be loaded, and for communicating the articles from an upper receiving position to a lower loading position. A first drive drives the transfer conveyor at a variable speed. A second drive oscillates the transfer conveyor between a first position and a second position. A controller is operably associated with the first drive for varying the driving speed of the transfer conveyor as a function of the position and direction of movement of the transfer conveyor. An article holder is disposed at the loading position for receipt of a transferred article.

A loading head for loading food articles comprises an intermediate conveyor for transferring articles in a first direction from a source. A transfer wheel is in operable communication with the intermediate conveyor for receiving the articles and for grouping the articles in predefined sets. A transfer conveyor is in operable communication with the transfer wheel, for receiving the sets of articles from the transfer wheel and for communicating the articles from an upper receiving position to a lower loading position. A first drive drives the transfer conveyor at a variable speed. A second drive oscillates the transfer conveyor between a first position and a second position. A controller is in operable communication with the first drive for varying the driving speed of the transfer conveyor as a function of the position and direction of movement of the transfer conveyor. An article holder is disposed at the loading position for receipt of a transferred article.

A method for loading food articles comprises the steps of transferring a supply of food articles onto a continuously driven transfer conveyor, oscillating the transfer conveyor between a first position and a loading position, and varying the driving speed of the transfer conveyor as a function of the position and direction of movement of the transfer conveyor. The food articles are discharged from the transfer conveyor at the loading position.

A method for loading food articles for packaging includes the steps of transferring a supply of food articles onto a continuously driven transfer conveyor, oscillating the transfer conveyor between a first position and a loading position, and varying the driving speed of the transfer conveyor as a function of the position and direction of movement of the transfer conveyor. The food articles are stripped from a holding surface at a constant speed and with uniform force at a rate that is independent of the rate at which the food articles are supplied from the source.

These and other objects and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention, illustrated in the accompanying drawings, wherein:

FIG. 9 is a top plan view of the frame of the loading head of the present invention;

FIG. 10 is a top plan view of the article holders of the present invention;

DETAILED DESCRIPTION OF THE PREFERRED EMBODIMENT

The food article loading head of the present invention is described in detail below with reference to the drawings. The loading head is particularly useful for efficiently grouping and loading franks into the pockets of a packaging machine. However, it should be understood that other similarly shaped articles, such as sausage links, bread sticks, snack sticks, and the like can be efficiently loaded into packaging containers through the use of the invention. Preferably, the food articles to be loaded and subsequently packaged are substantially similar in configuration and size, usually having an elongate shape.

Figure 1:
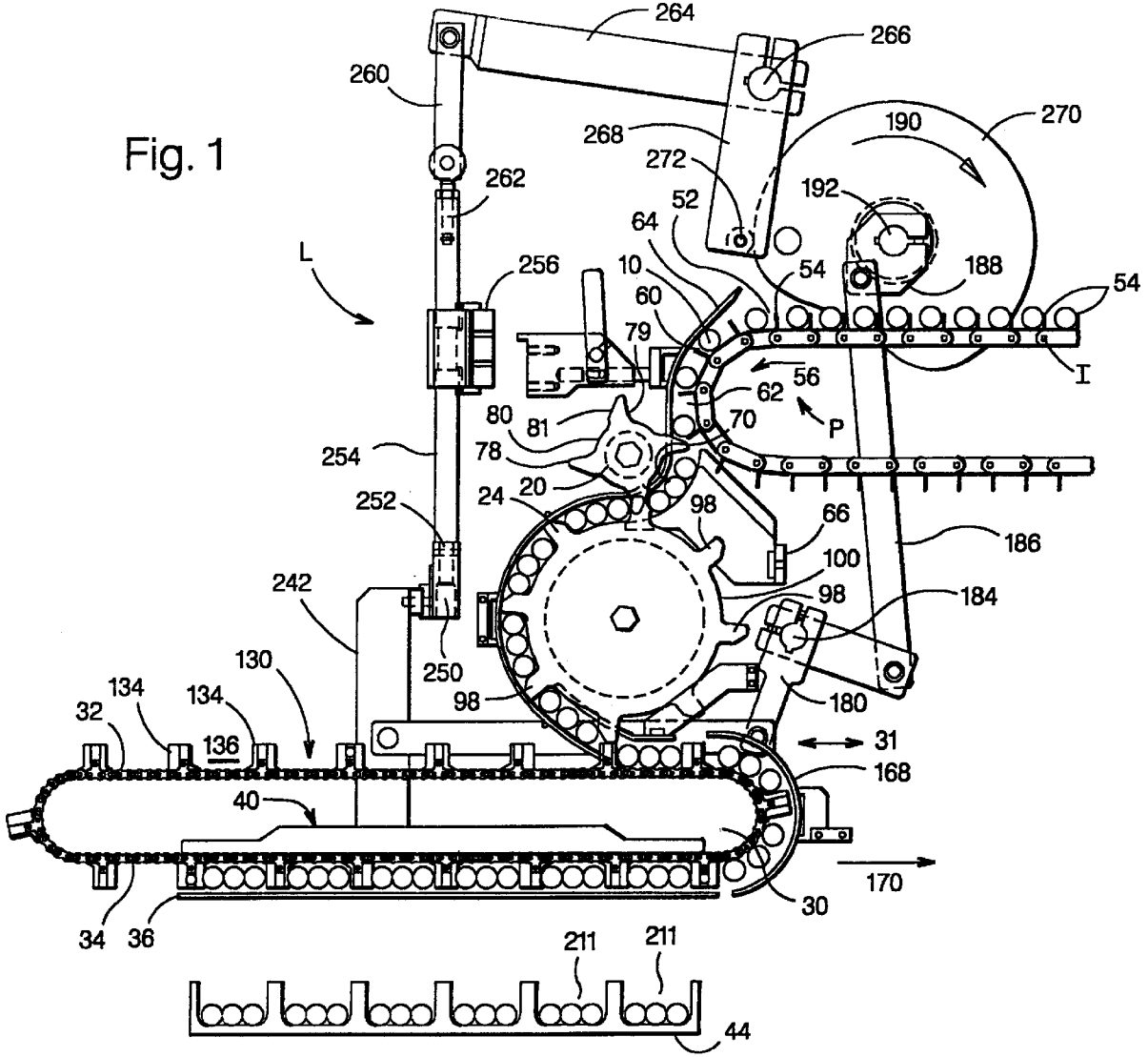
FIG. 1 is a fragmentary side elevational view, with portions broken away, showing the loading head of the present invention in a first orientation.
Figure 2:
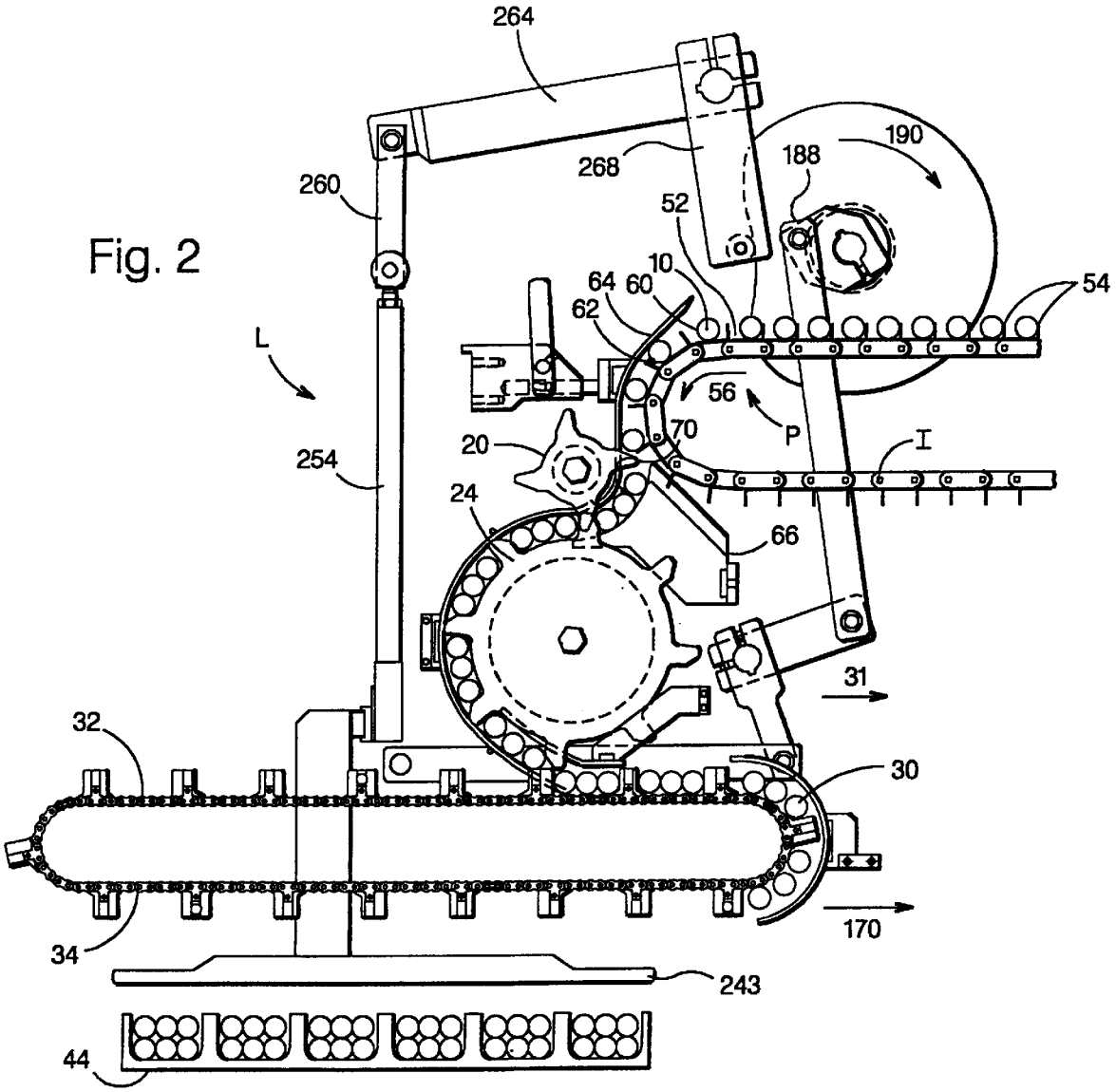
FIG. 2 is a fragmentary side elevational view, with portions broken away, showing the loading head in a second orientation.
Figure 3:
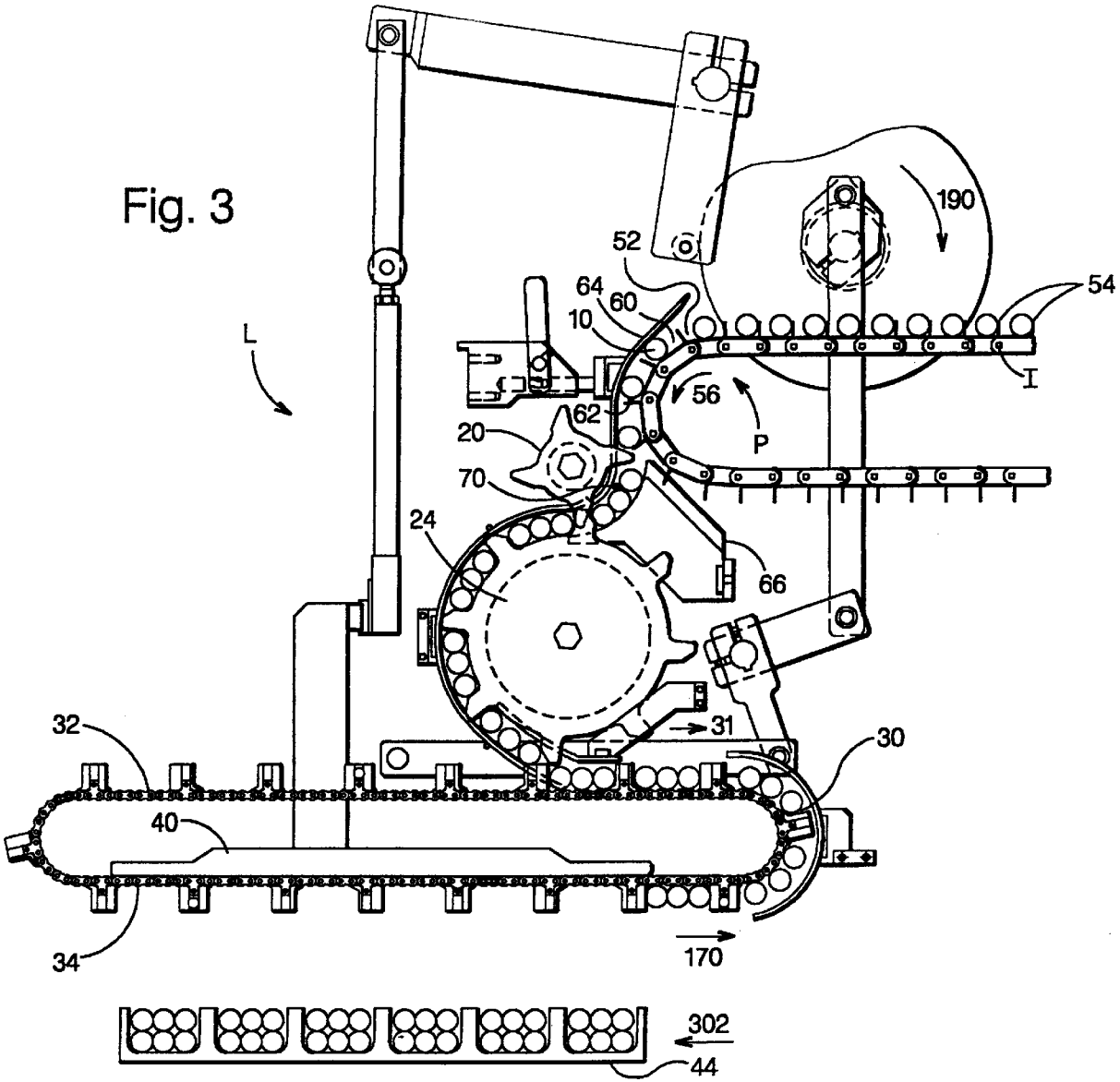
FIG. 3 is a fragmentary side elevational view, with portions broken away, showing the loading head in a third orientation.

Loading head L, as best shown in FIGS. 1–3, is operably connected to a parent loading machine P. Parent loading machine P includes an endless intermediate conveyor I that conveys food articles 10 in parallel relationship to loading head L, and operates in a known manner. In the preferred embodiment, intermediate conveyor I is designed to convey two rows of articles 10 to loading head L. However, it should be understood that the number of rows of articles conveyed by intermediate conveyor I to loading head L can vary, and is not limited to two rows. Consequently, the number of rows that may be accommodated by loading head L is a function of the product being supplied from the intermediate conveyor I. Additionally, essentially all parts of loading head L are fabricated from stainless steel, polymeric material, or the like, in order to facilitate clean-up.

Loading head L includes a sweeper device 20 which receives articles 10 from intermediate conveyor I, and groups articles 10 into sets. Each set contains a predetermined number of food articles 10. After articles 10 are grouped by rotating sweeper device 20, they are communicated as a group to rotating transfer wheel 24. Sweeper device 20 and transfer wheel 24 are made preferably from a durable plastic, so as to not damage the food products as they are advanced and which may be cleaned as necessary. Sweeper device 20 and transfer wheel 24 may be made of other materials that will not readily damage the food product. Transfer wheel 24 rotates in order to transfer articles 10 onto transfer conveyor 30, so that they may be transferred to the right as viewed with reference to FIG. 1.

Transfer conveyor 30 is an endless belt conveyor that communicates articles 10 from upper receiving position 32 to lower loading position 34, and rotates in a clockwise direction with respect to FIG. 1. An article holder 36, preferably comprising a pair of adjacently disposed hinged gates, is disposed at the lower loading position 34 for each row of grouped articles 10. Once an appropriate number of groups of articles 10 have been accumulated on article holder 36, then stripper device 40 operates to push articles 10 through article holder 36 into underlying packages 44. The packages may be vacuum packages, gas flush packages, trays, boxes, cartons, or other sorts of packaging used for distributing food products.

In order to increase the rate at which articles 10 are discharged into packages 44, stripper device 40 operates independently of the rate at which articles 10 are deposited onto transfer conveyor 30 by operation of transfer wheel 24. Typically, accumulation and grouping of articles 10 must be slowed or even stopped in order to permit articles 10 to be stripped into packages 44 disposed below article holder 36. In order to accomplish a constant rate of accumulation of grouped articles 10 onto transfer conveyor 30 while allowing articles 10 to be simultaneously stripped from article holder 36, then transfer conveyor 30 is oscillated in the direction of double headed arrow 31. As transfer conveyor 30 moves to the right as viewed in FIGS. 1–3, the speed at which the transfer conveyor 30 is driven or rotated is varied as a function of the position and direction of movement of transfer conveyor 30 relative to stripper device 40. Varying the speed of rotation of conveyor 30 permits food articles 10 to be supplied or fed at a constant rate at upper receiving position 32, while a varying transfer rate at lower loading position 34 is achieved. For a period of time during oscillation of transfer conveyor 30, the relative speed of transfer conveyor 30 at lower loading position 34 becomes zero, thereby permitting the strip to occur, as will be discussed in more detail below. At the same time, however, the speed at upper receiving portion 32 relative to transfer wheel 24 remains constant, so that transfer of food articles 10 by transfer wheel 24 can remain at a constant rate. The relative speed at upper portion 2 is constant, because any decrease in rotational speed of conveyor 30 is complemented by the travel speed of conveyor 30 attributable to its oscillation.

With reference to FIG. 1, intermediate conveyor I preferably is a link conveyor that includes compartments 52 for holding articles 10, with each compartment 52 separated from the immediately precedent and subsequent compartments by a flight 54. Intermediate conveyor I rotates in the direction of arrow 56, which is opposite to the direction of rotation of conveyor 30. Articles 10 are conveyed to end turn 60 of intermediate conveyor I, and drop into chute-like area 62. As articles 10 are conveyed into chute-like area 62, they are retained in the individual compartments 52 by rod assembly 64 and support plates 66.

Rod assembly 64 is a set of S-shaped guide rods that extend from end turn 60 of intermediate conveyor I to sweeper compartment area 70. The guide rods are disposed in spaced parallel relation to effectively retain articles 10 as they are transferred from end turn 60 to chute-like area 62 and sweeper compartment area 70. The guide rods are sufficiently spaced to guide articles 10 as they are transferred from intermediate conveyor I to loading head L.

Figure 4:
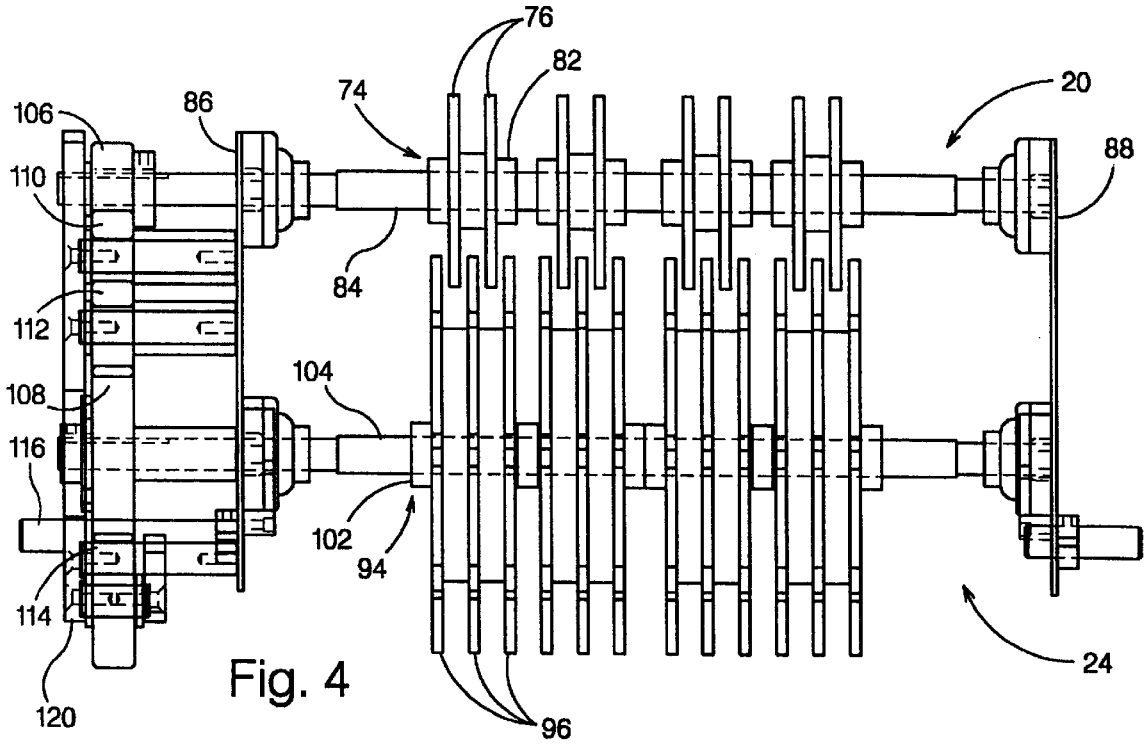
FIG. 4 is a front elevational view of the sweeper device and transfer wheel of the present invention.

Articles 10 are fed from chute-like area 62 to sweeper compartment area 70 by sweeper device 20, as best shown in FIG. 1. Sweeper device 20 includes at least two sweeper members 74 per row of articles 10, as best shown in FIG. 4. Sweeper members 74 are spaced a distance sufficient to support an article 10 at its ends. Consequently, in the preferred embodiment, there are four sweeper members 74, two associated with each row of articles 10 to be packaged. However, it should be understood that the number of sweeper members 74 may be increased or decreased to accommodate more or less rows, according to the number of rows fed from intermediate conveyor I.

Each sweeper member 74 includes at least one wheel 76, each wheel 76 including a plurality of spaced, outwardly extending fingers 78 defining a plurality of pockets 80 therebetween. Each finger 78 has angularly extending surfaces 79 and 81 which facilitate receipt of food articles 10 from conveyor I, and transfer of the food articles 10 to transfer wheel 24, as best shown in FIG. 1. Preferably, there are two wheels 76 associated with each sweeper member 74, to better support the article 10 as it is is grouped. Grouping is accomplished because the food articles 10 are fed from conveyor I at a constant rate, and accumulated in pockets 80. The size of pockets 80 thus determines the number of articles 10 in a group. A corresponding collar 82 secures the two wheels 76 of each sweeper member 74. Each collar 82 is secured about shaft 84, which is supported between side support plates 86 and 88, as best shown in FIG. 4. It should be understood that there may be more than two wheels 76 associated with each sweeper member 74, or one wheel 76 which is sufficiently wide to support and group articles 10 as they are conveyed from intermediate conveyor I.

Sweeper members 74 are rotated in synchronization to group articles 10 as they are transferred from intermediate conveyor I. Preferably, sweeper device 20 rotates at a constant speed, in conjunction with the rate at which the articles 10 are supplied from intermediate conveyor I. Sweeper device 20 engages articles 10 to create predetermined sets of articles 10. In the preferred embodiment, each wheel 76 includes four fingers 78, which are spaced apart to accommodate three articles 10 between adjacent fingers 78. Wheels 76 are rotated about a common axis and fingers 78 are aligned during rotation of the wheels 76.

As sweeper device 20 transfers articles 10 into sweeper compartment area 70, articles 10 are retained between rod assemblies 64 and support plates 66, as best shown in FIG. 1. After a group of articles 10 has been formed in sweeper compartment area 70 by sweeper device 20, the grouped articles 10 are transferred to transfer wheel 24, as best shown in FIG. 1. Transfer wheel 24 is disposed below sweeper device 20, and causes articles 10 to be transferred from sweeper compartment area 70 to oscillating transfer conveyor 30.

Transfer wheel 24 includes at least two transfer member 94 per row of articles to be grouped, as best shown in FIG. 4. Transfer members 94 are spaced a distance sufficient to support an article 10 at its ends. Consequently, in the preferred embodiment, there are four transfer members 94, two associated with each row of articles 10 to be packaged. However, it should be understood that the number of transfer members 94 may be increased or decreased to accommodate more or less rows, according to the number of rows fed from intermediate conveyor I.

Each transfer member 94 is operably associated with a respective sweeper member 74. Each transfer member 94 includes at least one wheel 96, each wheel 96 including a plurality of spaced, outwardly extending fingers 98 defining a plurality of pockets 100 therebetween. Wheels 76 are interposed between wheels 96, as best shown in FIG. 4. Wheels 96 are rotated about a common axis, and fingers 98 are aligned during rotation of wheels 96. Preferably, there are three wheels 96, which are staggered between corresponding sweeper wheels 76. A corresponding collar 102 secures each set of fingered wheels 96. Collar 102 is secured to drive shaft 104, which is secured between side plates 86 and 88.

In the preferred embodiment, there are eight fingers 98 on each of the wheels 96, each finger 98 sufficiently spaced to retain three articles 10 in a pocket 100. The fingers 98 are equiangularly circumferentially spaced about wheels 96, so that pockets 100 are uniformly sized. However, like sweeper device 20, transfer wheel 24 may be sized according to the number of articles 10 to be set in each package. Likewise, in the preferred embodiment, sweeper device 20 and transfer wheel 24 are sized with respect to one another in order to accommodate the same number of articles 10. Thus, pockets 80 of sweeper device 20 are substantially equal in size to pockets 100 of transfer wheel 24, although non-uniformly sized pockets 80 and 100 are possible to implement. In addition, the speeds at which transfer wheel 24 and sweeper device 20 are rotated are in synchronization with each other, although sweeper device 20 necessarily rotates faster than wheel 24 due to its small diameter and its need to supply food articles 10 to the pockets 100 as they are positioned at sweeper device 20.

Figure 5:
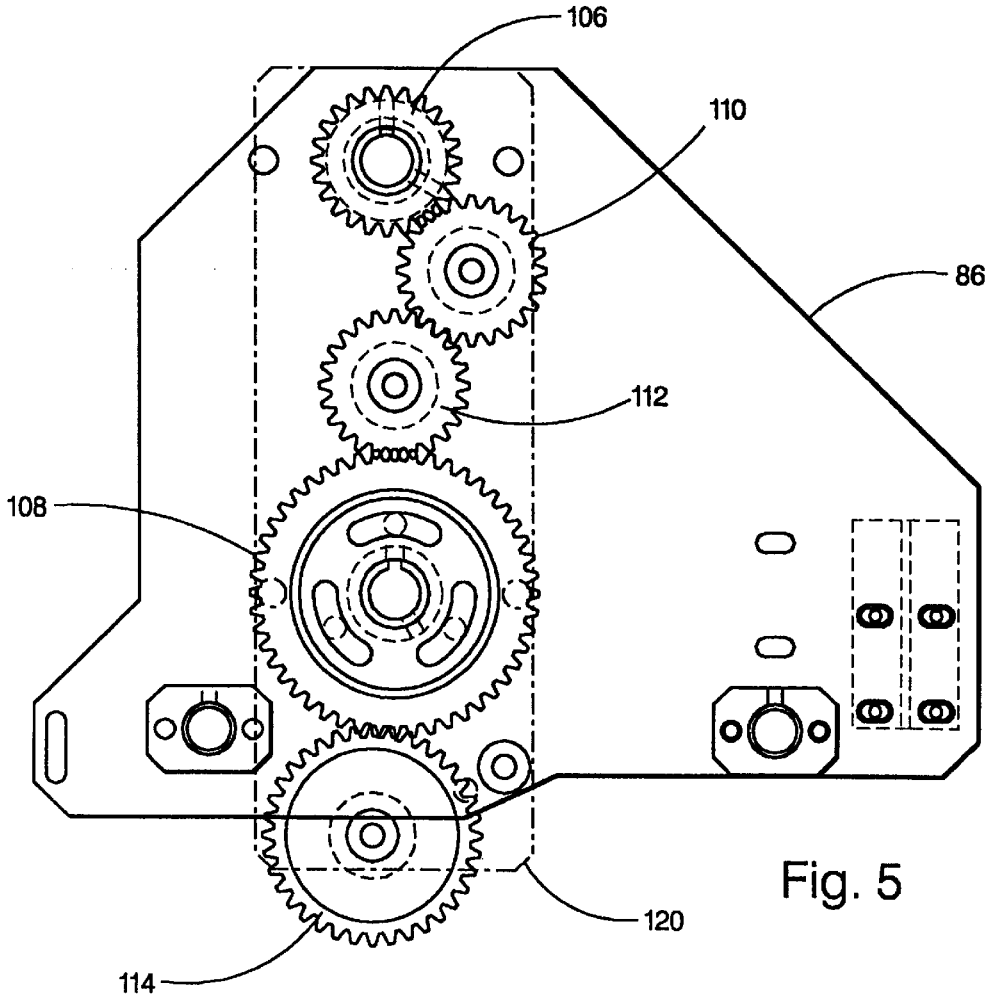
FIG. 5 is a side elevational view of the gear train driving the sweeper device and the transfer wheel of the present invention.

Shaft 84 is operably connected to gear 106, which causes shaft 84 to rotate as gear 106 is driven, as best illustrated in FIGS. 4 and 5. Likewise, shaft 104 is operably connected to gear 108, which causes shaft 104 to rotate as gear 108 is driven. In order to coordinate the speeds at which shaft 84 and shaft 104 are rotated, idler gears 110 and 112 operably connect gears 106 and 108. Gear 114 motor driven and is disposed below gear 108. The gears 106, 108, 110, 112, and 114 provide a gear train that controls rotation of shafts 84 and 104. The gear train is supported between support plate 86 and gear plate 120.

As best shown in FIG. 1, articles 10 are transferred from sweeper device 20 to transfer wheel 24. The articles 10 are rotated approximately 180° by transfer wheel 24, and are then fed onto transfer conveyor 30. As articles 10 are rotated about transfer wheel 24, they are retained by rod assembly 124, which guides articles 10 as they are advanced by transfer wheel 24. Rod assembly 124 is similar in structure to rod assembly 64. Each rod assembly 124 is a set of guide rods which extends in a semi-circular configuration about the edge of transfer wheel 24.

Oscillating transfer conveyor 30 is positioned below transfer wheel 24 to receive grouped articles 10, as best shown in FIG. 1. Transfer conveyor 30 includes at least two adjacently disposed endless chain conveyors 130 spaced a distance sufficient to support an article 10 as it is transferred to article holder 36. However, it should be understood that the number of endless chains 130 may be varied to accommodate the number of rows fed from intermediate conveyor I. Each endless chain 130 includes a plurality of outwardly extending lugs 134 defining a plurality of pockets 136 therebetween. Chains 130 are driven about common axes. Lugs 134 are aligned during rotation of chains 130. Pockets 136 are sized to receive the same number of articles 10 as grouped by sweeper device 20 and transfer wheel 24 into sets. Hence, sweeper device 20 creates sets of articles 10 of predetermined number. Each set is transported by wheel 24, and ultimately deposited onto conveyor 30.

Figure 6:
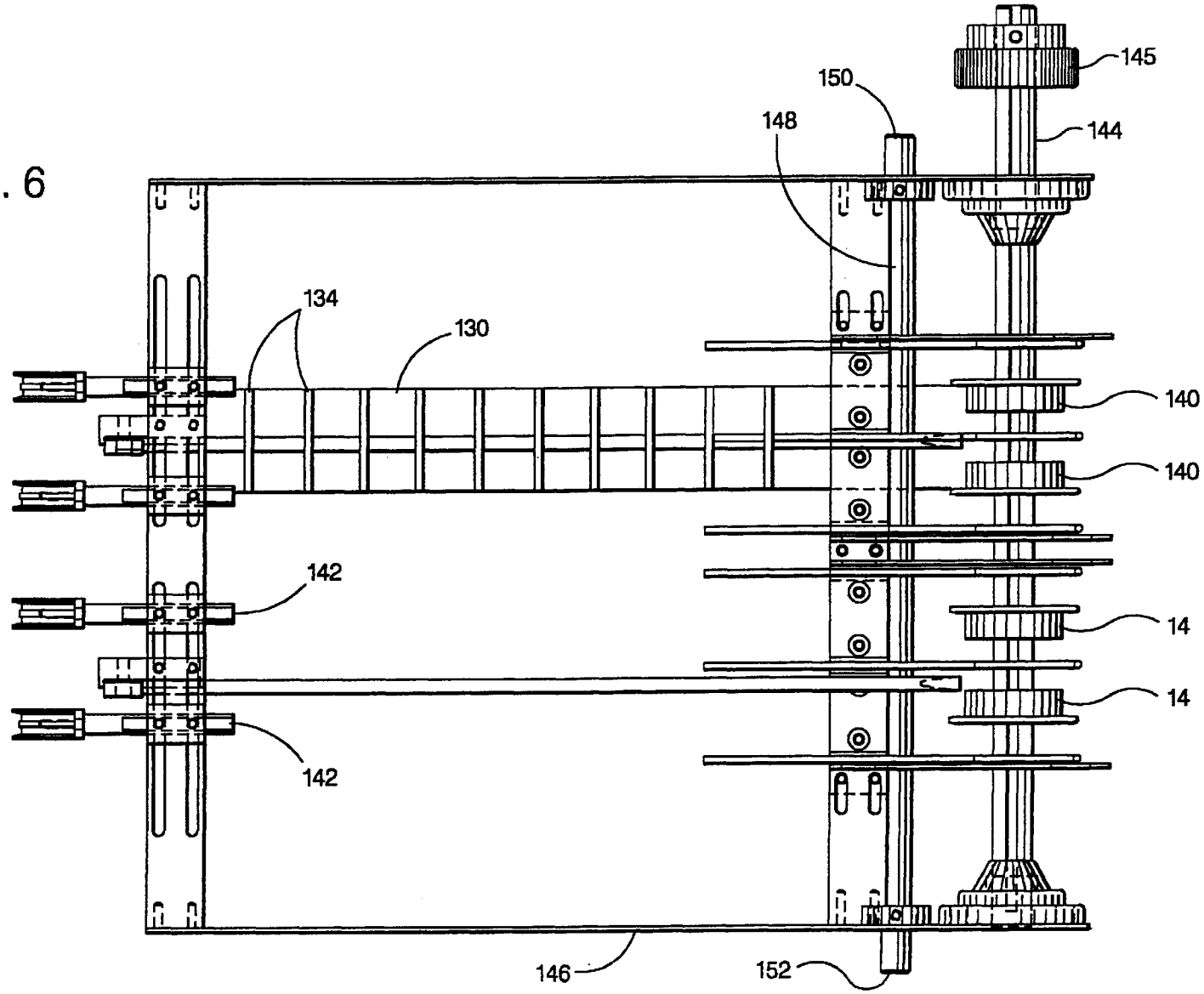
FIG. 6 is a top plan view of the transfer conveyor assembly of the present invention.

Endless chains 130 extend between sprocket 140 at one end and grooved block 142 at is other end, as best shown in FIG. 6. Sprockets 140 are secured to drive shaft 144, which includes a gear 145 at its end. Gear 145 is operably connected to a corresponding gear disposed on oscillating rack 154 of FIGS. 7(*a*), (*b*), and (*c*), as will be described in more detail below.

Figure 7A:
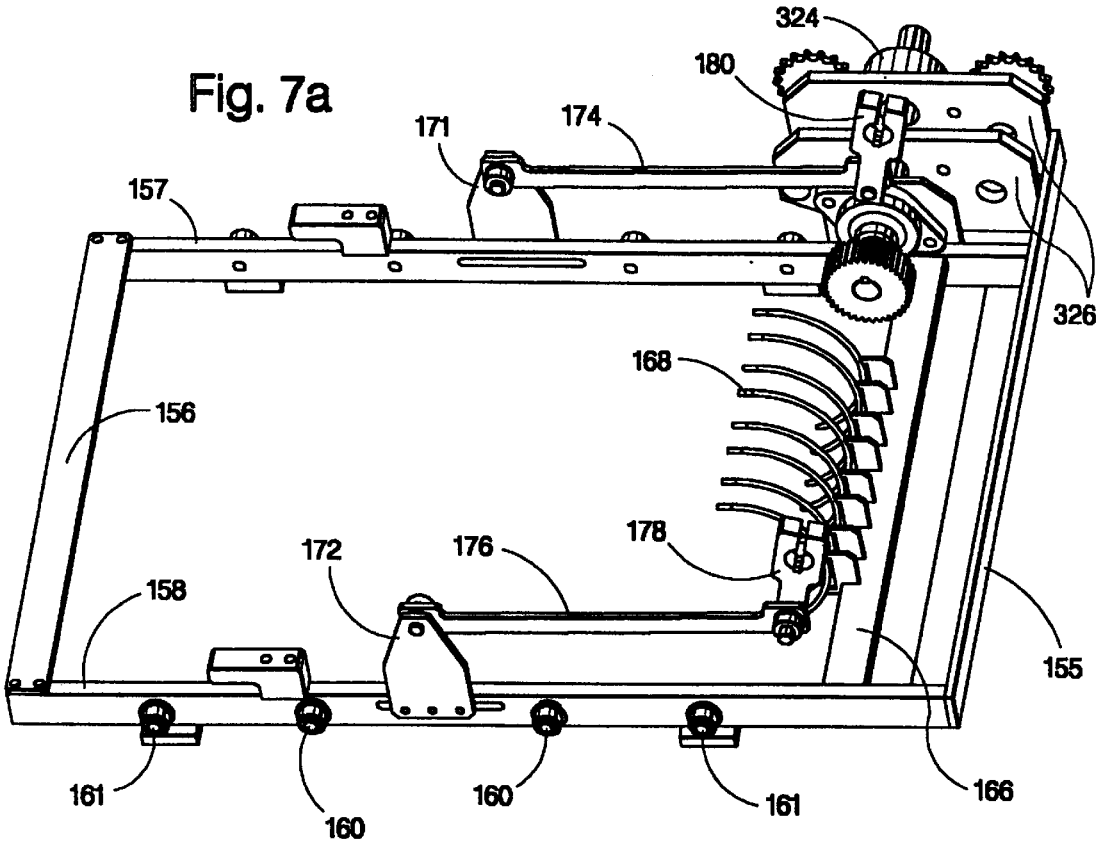
FIGS. 7(*a*), (*b*), and (*c*) are fragmentary perspective views with portions broken away of the oscillating rack of the transfer conveyor of the present invention.
Figure 8:
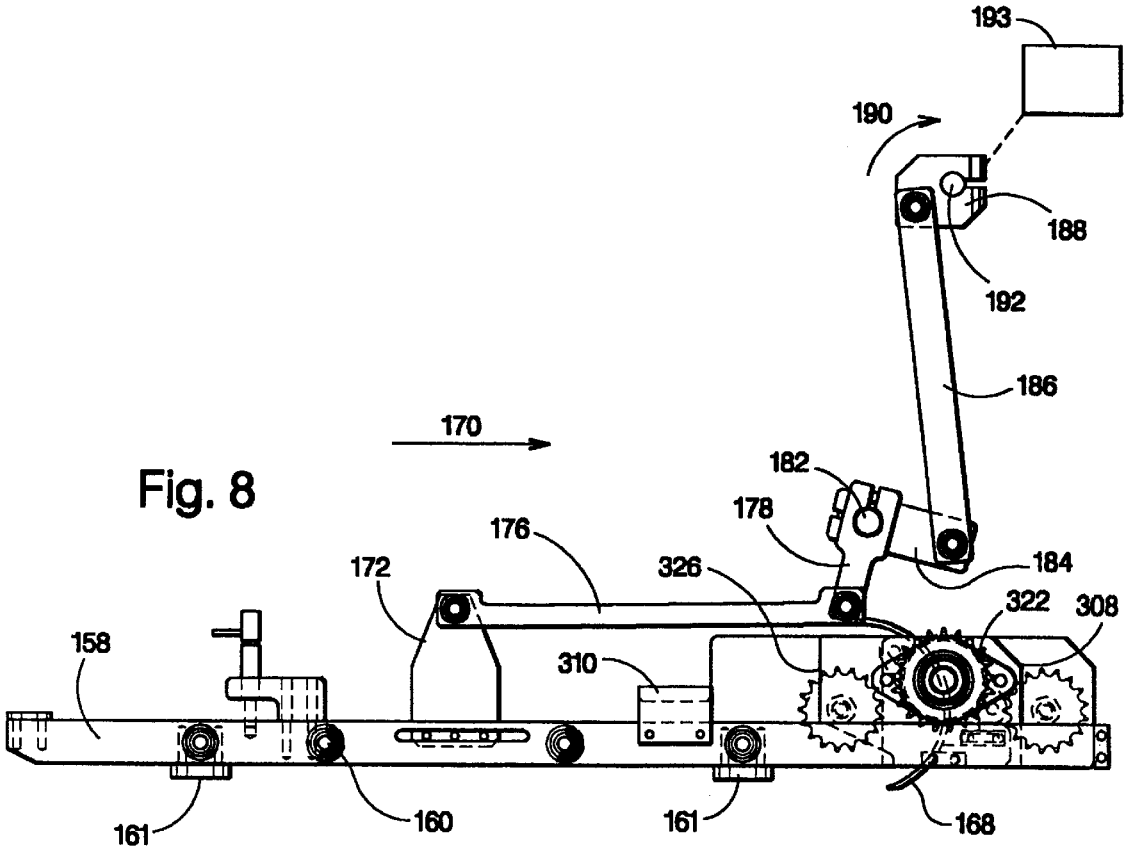
FIG. 8 is a side elevational view of the oscillating rack of the transfer conveyor of the present invention.
Figure 7B:
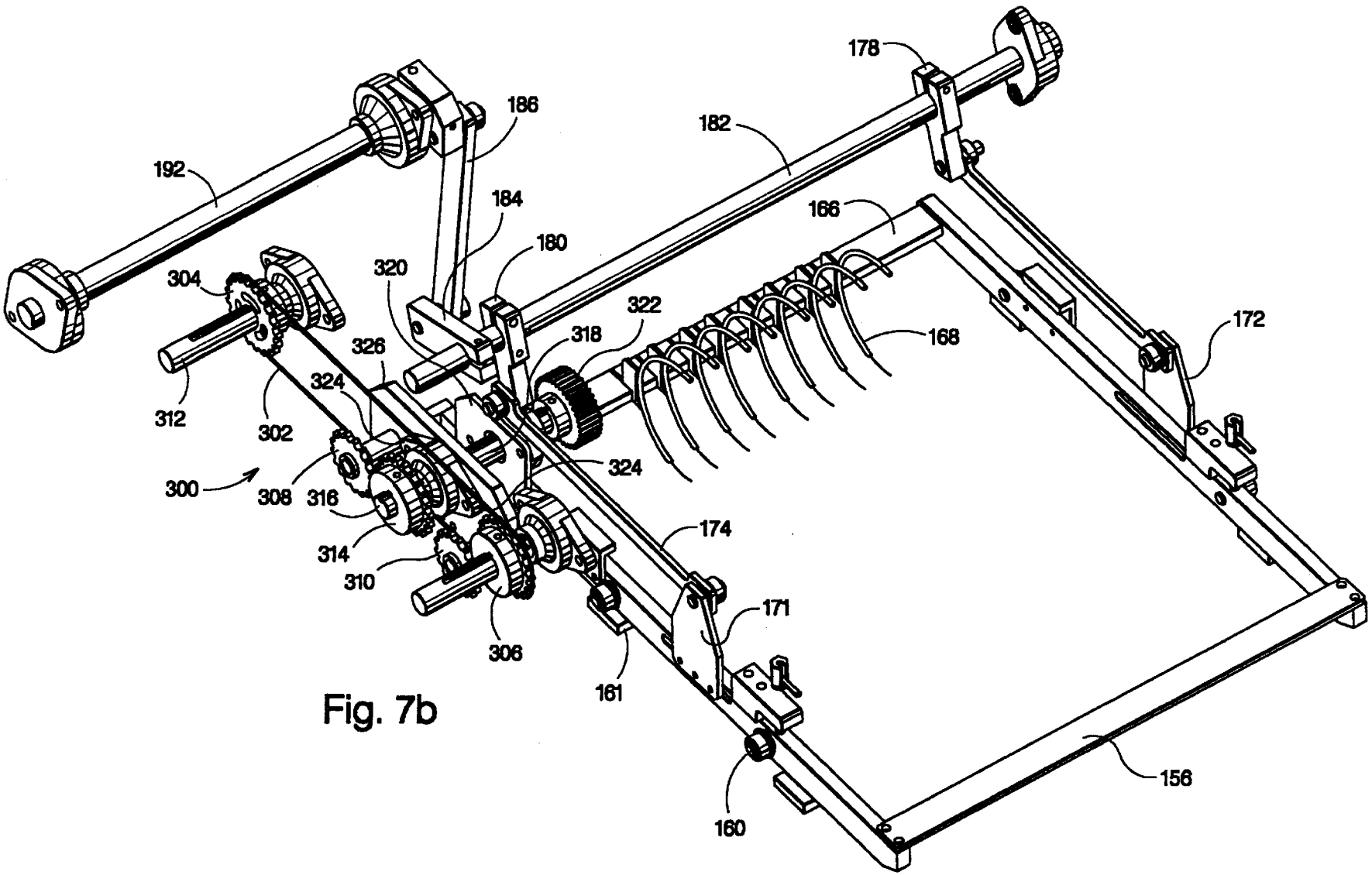
Figure 7C:
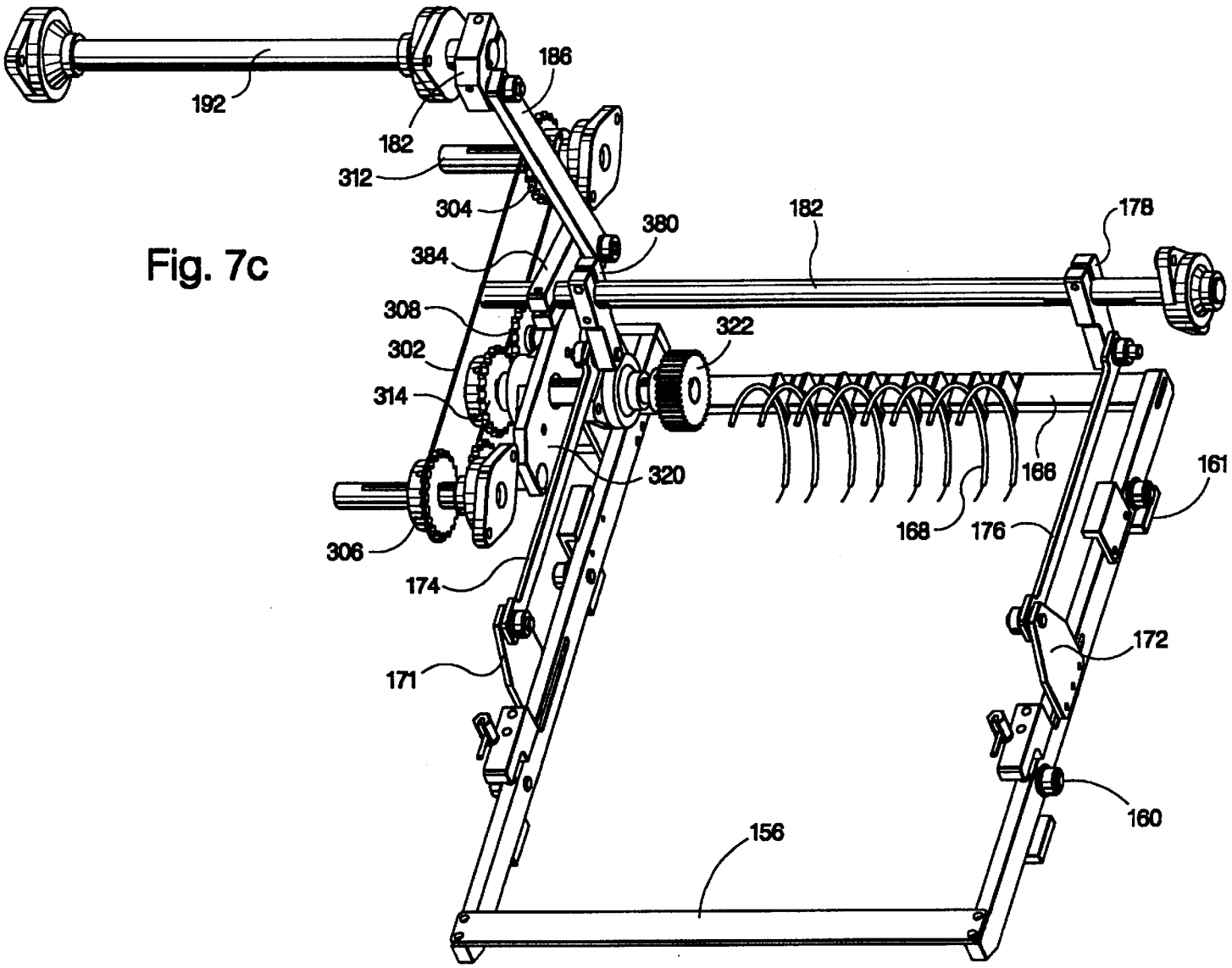

Endless chains 130 of transfer conveyor 30 are rotatably mounted to chain module 146. Chain module 146, as best shown in FIG. 6, includes a cross bar 148 with protruding end portions 150 and 152, which extend beyond the perimeter of chain module 146, and allow chain module 146 be mounted in oscillating rack 154 of FIG. 7(*a*). In order to mount chain module 146 in oscillating rack 154, protruding end portions 150 and 152 are received within sockets of oscillating conveyor rack 154. As best shown in FIGS. 7–9, oscillating rack 154 includes front support bar 155, rear support bar 156, and side support bars 157 and 158, forming a generally rectangular frame. Side bars 157 and 158 are disposed in parallel relation, each including rollers 160 disposed at its outer edge. In the preferred embodiment, there are four rollers 160 disposed along each side support bar 157 and 158. Rollers 160 permit transfer conveyor 30 move while being oscillated. Side support bars 157 and 158 include flanged members 161 disposed beneath rollers 160. Members 161 provide a base for maintaining stability of rack 154 during oscillation, in order to prevent oscillating rack 154 from becoming derailed during its oscillation. Oscillating conveyor rack 154 moves along horizontal support rails 162 and 163, which are secured between main support frames 164 and 165 of loading head L, as best illustrated in FIG. 9.

Figure 12A:
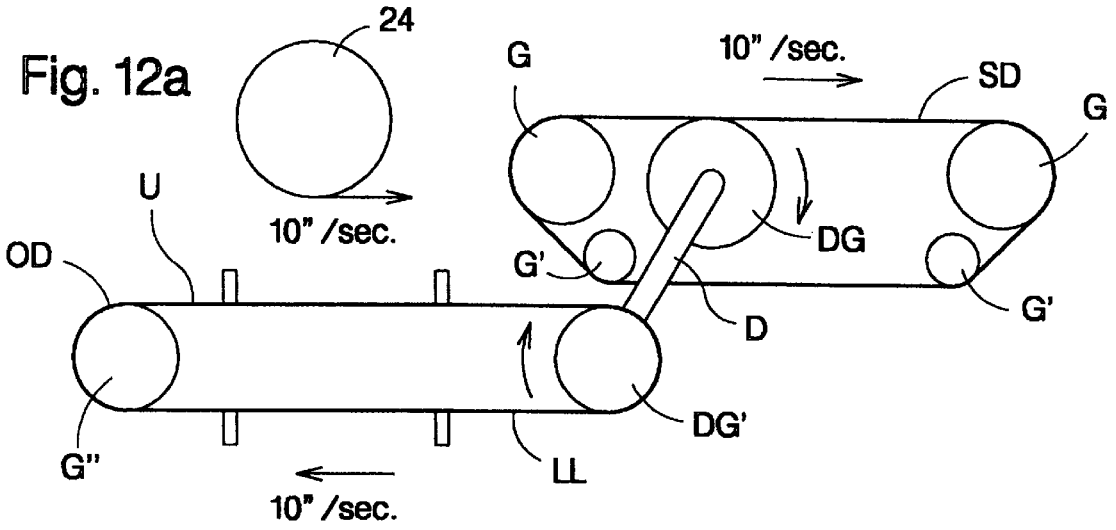
FIGS. 12(*a*), (*b*), and (*c*) are schematic views illustrating the controller used foroscillating the transfer conveyor of the invention.
Figure 12B:
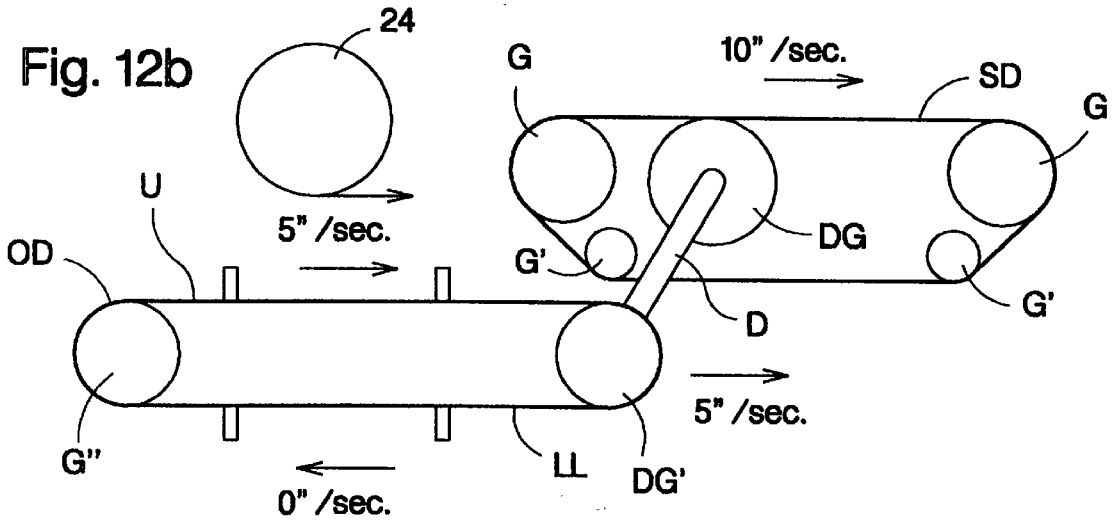
Figure 12C:
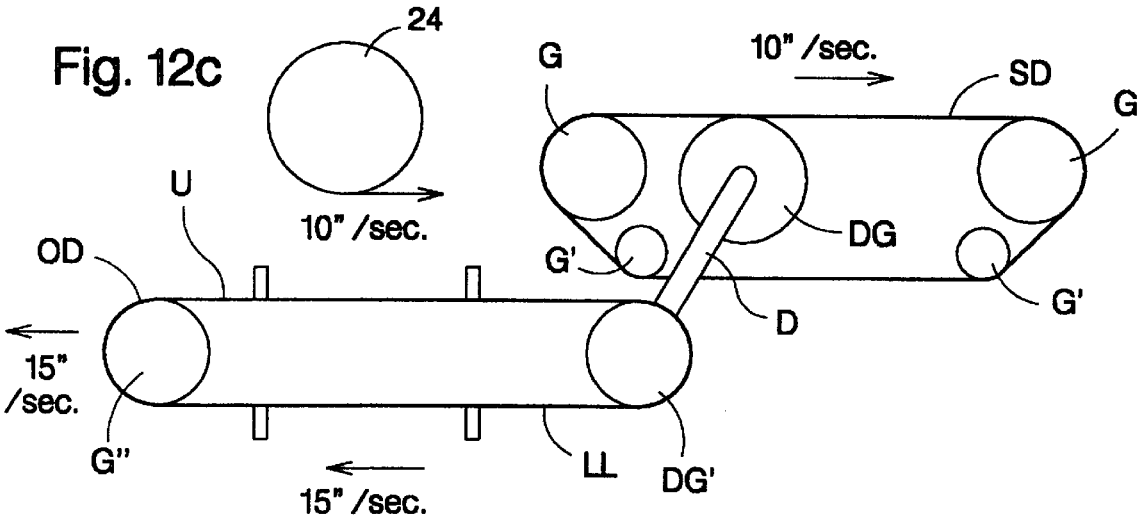

FIGS. 12(*a*), (*b*), and (*c*) are schematic diagrams illustrating how the speed of rotation of the chains 130 is controlled by oscillation of rack 154. FIG. 12(*a*) discloses stationary chain drive SD rotating at a constant speed of, for example, 10 inches per second about upper sprockets G and lower sprockets G'. Drive shaft D has a sprocket DG meshingly engaged with the chain of chain drive SD and an opposite sprocket DG' meshingly engaged with the chain of oscillating drive OD. The chain of drive OD trains about sprockets G" and DG'. Rotation of sprocket DG by the chain of drive SD causes corresponding rotation of the chain of drive OD. If the drive OD is fixed in position, then the chaims of the drives SD and OD rotate at the same speed.

Movement of drive OD toward the right, as viewed in FIG. 12(*b*), causes the speed of rotation of the chain of drive OD to be decreased. The chain of drive SD continues to rotate at a fixed speed, but because sprocket DG is traveling in the same direction as the chain of drive SD, then its rotation speed is slowed. Thus the speed of movement of drive OD plus the speed of rotation of the chain of drive OD equals the speed of rotation of the chain of drive SD. Hence, along the upper portion U of the chain of drive OD, the speed relative to the transfer wheel 24 remains constant. At the lower portion LL, however, the speed is reduced because the speed of drive OD is reduced and also moving opposite to the direction in which the chain is being driven along lower portion LL. Food products may thus be deposited onto the chain of drive OD on upper portion U at a constant rate, and removed from the chain along the lower portion LL when a speed of zero relative to the stripper 40 is achieved.

Movement of drive OD toward the left in FIG. 12(*c*) again controls the speed of the chain relative to transfer wheel 24 and holder 36. When moving to the left, sprocket DG is traveling in the opposite direction as the chain of drive SD, with the result that it rotates faster and thus correspondingly rotates the chain of drive OD faster. The speed along lower portion LL is thus increased, while the speed relative to transfer wheel 24 again remains constant.

Oscillation of drive OD thus permits the chain speed relative to transfer wheel 24 to remain constant, so that food products may be loaded onto the chain at a constant rate. The speed relative to holder 36 along lower portion LL varies, and at times is zero, thus permitting stripper 40 to operate in order to deposit the articles 10 into the packages 44. The rotational speed of the chain of the drive OD (is thus controlled by sprocket DG) and the chain of drive SD as a function of the instantaneous position of the transfer conveyor 30 relative to transfer wheel 24 and the instantaneous direction in which the transfer conveyor 30 is moving. (This may be thought of as the rate at which the transfer conveyor 30 is instantaneously moving.) Thus, the stripping of the articles 10 from holder 36 is independent of the rate at which the articles 10 are fed onto the chains 130.

As best shown in FIGS. 7(*a*), (*b*), and (*c*), a cross bar 166 is secured between side support bars 157 and 158, and provides support for rod assembly 168, disposed at the end of the transfer conveyor 30. Rod assembly 168 retains articles 10 as they are conveyed between the upper receiving position 32 to the lower loading position 34. Rod assembly 168 comprises a plurality of guide rods that are semi-circular in elevation.

As articles 10 are fed by chains 130 about the end turn of transfer conveyor 30, transfer conveyor 30 is moved in the direction of arrow 170, as best shown in FIGS. 1, 7(*a*) and 8. Oscillating conveyor rack 154 includes link plates 171 and 172 that are secured to side support bars 157 and 158, respectively. Secured to each link plate 171 and 172 is a link push bars 174 and 176, respectively, which in turn are secured to bell cranks 180 and 178, respectively. Bell cranks 178 and 180 are connected by a shaft 182 that extends from bell crank 178, through bell crank 180, to link arm 184. Link arm 184 is connected to link crank 186, which is operably connected to a rotatable eccentric 188.

Eccentric 188 rotates in a clockwise direction 190, as viewed relative to FIG. 8, by way of shaft 192, causing link crank 186 by way of link arm 184 to rotate shaft 182, thereby causing bell cranks 178 to 180 to pivot as shaft 182 is pivoted. Motor 193 is operatively connected to shaft 182 for causing rotation of shaft 182. As bell cranks 178 and 180 pivot, link arms 174 and 176 move linearly, causing transfer conveyor 30, which is rigidly connected to link plates 170 and 172, to correspondingly move linearly. While the preferred embodiment has been described as using a crank arm for causing oscillating motion of the conveyor 30, a cam and linkage may perform the same function. In addition, servo drives may also be used to provide oscillation and drive for the conveyor.

FIGS. 7(*b*) and (*c*) illustrate the stationary drive 300, which corresponds to the drive SD of FIGS. 12(*a*), (*b*), and (*c*), and the oscillating drive corresponding to the drive OD of FIGS. 12(*a*), (*b*), and (*c*). Chain 302 extends about main sprockets 304 and 306, and idler sprockets 308 and 310. Shaft 312 is secured to sprocket 304. Shaft 312 is driven by an electric motor at a constant velocity, so that sprocket 304 is rotated at a constant velocity also. Rotation of sprocket 304 causes chain 302 to be driven.

Sprocket 314 is meshingly engaged with chain 302. Shaft 316 is secured to sprocket 314 and extends through opening 318 in support 320. Gear 322 is mounted to the opposite end of shaft 316 and is rotatable therewith. Shaft 316 is secured by bearing 324 to support 326. Support 326 and support 320 are secured to rack 154. Oscillating movement of rack 154 causes corresponding movement of sprocket 314 along chain 302 between sprockets 304 and 306. Sprockets 308 and 310 are attached to support 326. Gear 145 of FIG. 6 is meshingly engaged with gear 322 in order to cause cooperating rotation of shaft 144. Chains 130 extend between sprockets 140 and blocks 142, as best shown in FIG. 6, so that rotation of shaft 144 through action of gears 322 and 145 causes the chains 130 to be correspondingly rotated or driven.

As explained with regard to FIGS. 12(*a*), (*b*), and (*c*), oscillation of rack 154 causes the rotational speed of chaims 130 to be controlled as a function of the rate or instantaneous position and direction of movement of transfer conveyor 30. As the bell cranks 178 and 180 pivot, they cause the rack 154 to move linearly. As the frame 154 moves, the sprocket 314, and idler sprockets 308 and 310, move along the chain 302. The chain 302 rotates at a constant speed, so that movement of sprocket 314 along chain 302 controls the speed of rotation of shaft 144 as a function of the rate or position and direction of movement of rack 154.

As best shown in FIGS. 1 and 10, article holder 36 includes two hinged gates 200 for each row of articles to be packaged. Gates 200 are spaced a distance sufficient to support an article 10 at its end. Each gate 200 is biased toward the horizontal by torsion springs 204. Each gate 200 requires the use of at least one torsion spring 204. Springs 204 bias the gates 200 to a substantially horizontal orientation, and return the gates 200 to this orientation once the downward force of the stripper device 40 is removed.

Hinged gates 200 are disposed in parallel in order to maintain a predetermined gap throughout their length. Gates 200 provide aligned surfaces upon which articles 10 lie before being loaded into packages 44 disposed below article holder 36. The distance between adjacent gates 200 is set according to the length of articles 10. The width of gates 200 is sufficient to support the ends of articles 10 in planar relationship. The gates 200 are set uniformly, so that stripper devices 40 will apply uniform force to the articles 10 during the stripping operation.

Once deposited on hinged gates 200, articles 10 are discharged into underlying packages 44 by operation of stripper device 40, as best shown in FIGS. 1–3. Packages 44 each include a plurality of pockets 211, which are positioned beneath article holder 36 and are conveyed to and from the loading head L in synchronization with operation of the stripper device 40. Pockets 211 are sized according to the number of articles 10 grouped for packaging. In the preferred embodiment, pockets 211 are sized to receive groups of three articles 10. However, it should be understood that the pockets may be sized to receive larger or smaller groups of articles 10. Moreover, while six pockets 211 are disclosed, loading head L may have a greater or fewer number of pockets 211 that are to be simultaneously filled. The oscillation of transfer conveyor 30 permits the accumulation of a group of food articles 10 for each pocket 211.

Stripper device 40 applies force to food articles 10, causing hinged gates 200 to open and deposit a load of articles 10 into pockets 211, as best illustrated in FIGS. 1–3. Preferably stripper device 40 includes a plurality of stripper legs 242 mounted to block 250. Feet 243 extend horizontally from legs 242, and engage the food articles 10 during the stripping operation. Block 250 has a bore 252 in its upper surface for securing the base end of ramrod 254. Ramrod 254 is supported at its upper end by rod support 256, which permits movement of ramrod 254 within rod support 256. As ramrod 254 translates through rod support 256, stripper feet 243 are caused to move in a vertical direction.

Ramrod 254 is secured at its upper end to link arm 260 through rod end 262. Link arm 260 is secured at its other end to stripper beam 264, which is secured to shaft 266 at its other end. Shaft 266 is operably connected to crank arm 268, which is operatively connected to cam 270 by cam follower 272. Crank arm 268 is biased so that follower 272 remains engaged with cam 270. Cam 270 is secured to shaft 192, so that oscillation of the transfer conveyor 30 is coordinated with the discharge of articles 10 by stripper device 40. As a result, stripper beam 264 and link arm 260 pivot about shaft 266, causing ramrod 254 to move vertically. Stripper feet 243 are thus caused to apply a force to food articles 10, which then move through hinged gates 200.

Figure 11:
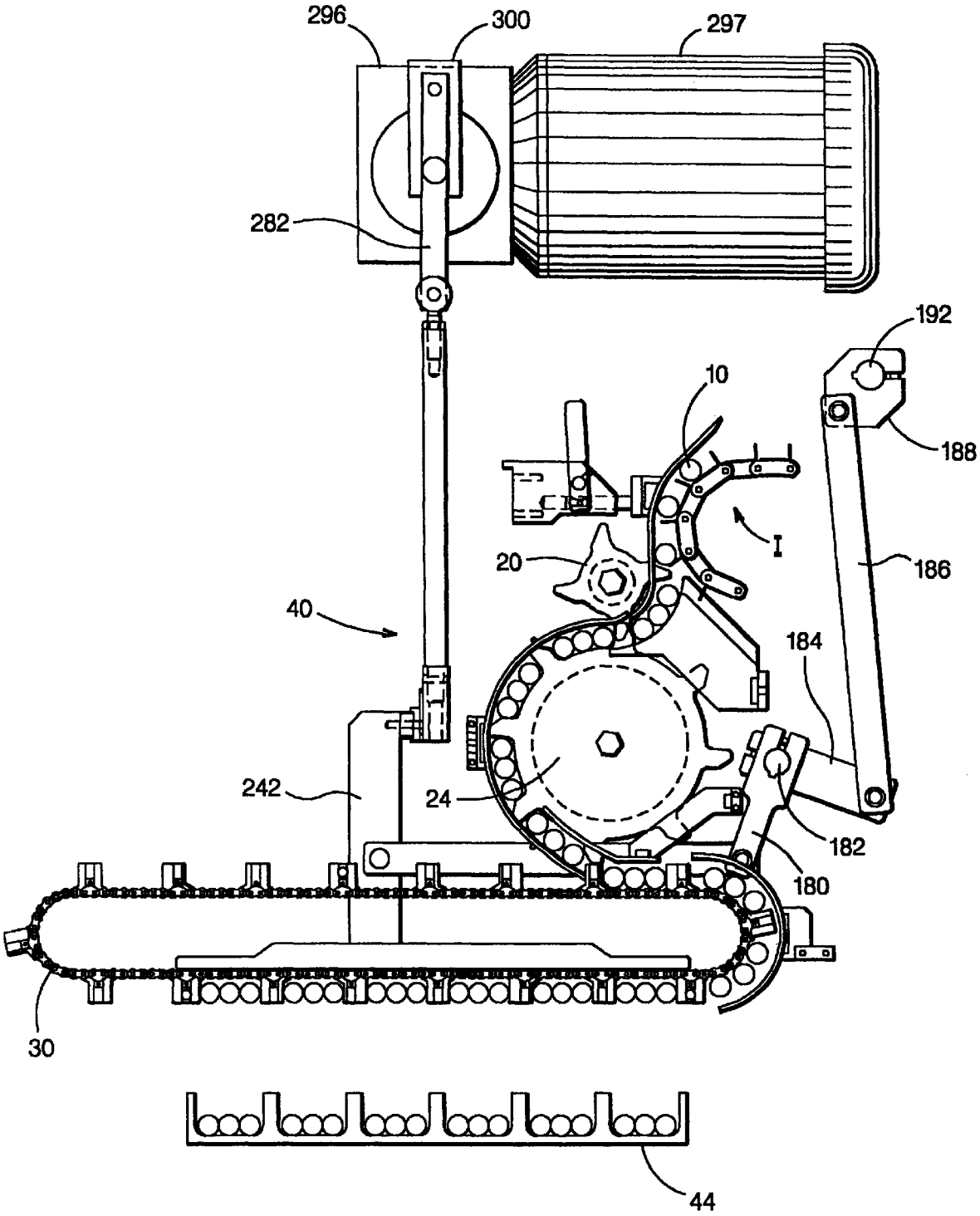
FIG. 11 is a fragmentary side elevational view, with portions broken away, of an alternative embodiment of the present invention.

Alternatively, as best shown in FIG. 11, stripper device 40 may be driven through hinged gates 200 by intermittent operation of single revolution clutch 296. In this embodiment, link arm 282 is secured at its end to eccentric 300, which is operably connected to single revolution clutch 296. After activating single revolutionclutch 296, eccentric 300 rotates 180° by operation of motor 297,. Arm 282 is thus caused to move downwardly, so that stripper feet 243 descend. As link 300 moves another 180°, link 282 is caused to move upwardly, thereby moving stripper feet 242 upwardly. The separate motor 297 permits stripper feet 243 to be driven at a constant strip speed, regardless of the speed at which the loading head L is operating. Thus, food products 10 may be stripped at a constant speed and through application of uniform force, so that stripping action is optimized.

As best shown in FIGS. 1–3, the operation of loading head L will be described in more detail. As described above, articles 10 are conveyed from intermediate conveyor I at a constant rate. Sweeper device 20 groups articles 10 received from intermediate conveyor I and transfers them to transfer wheel 24. The grouped articles 10 are rotated about the transfer wheel 24, and deposited onto oscillating transfer conveyor 30. The rates at which intermediate conveyor I, sweeper device 20, and transfer wheel 24 are driven remain constant throughout the operation of loading head LHowever, the rate at which the endless chains 130 are rotated is varied in direct relation to the position and direction of movement of transfer conveyor 30.

In order to create a variable accumulation between sweeper device 20 and stripper device 40, transfer conveyor 30 is translated from a first orientation, as best shown in FIG. 1, to a second orientation, as best shown in FIG. 3. During its translation from its first orientation to its second orientation, stripper device 40 is operated to discharge articles 10 into underlying pockets 211. The stripper device 40 operates during that period of time when the speed of the lower portion of the chains 130 carried by rack 154 is zero relative to stripper 40. Because the chains 130 are stopped relative to feet 243, then the stripping operation may proceed. At the same time, as previously explained, the relative speed at upper portion 32 is constant relative to transfer wheel 24, so that loading of food articles 10 onto transfer conveyor 30 continues at a constant rate.

As stripper device 40 unloads articles 10 into pockets 211, transfer conveyor 30 is moved linearly, to the right as viewed in FIG. 2, preferably at a velocity of one half the speed of endless chains 130. The chain velocity of endless chains 130 is decreased in order to complement the linear velocity, so that a continuous infeed of product 10 is accomplished at the top of conveyor 30. At this point of the oscillation, the velocity at the bottom of conveyor 30 is zero, enabling a smooth transfer of articles 10 into pockets 211 by stripper device 40.

As best shown in FIG. 3, transfer conveyor 30 continues to move to the right until stripper device 40 is returned to its upper park position. After stripper device 40 returns to its upper park position, transfer conveyor 30 moves in direction of arrow 302, back to its first position, as best shown in FIG. 1. Transfer conveyor 30 moves back to its first position preferably at a velocity of one half the speed of endless chains 130. The relative speeds of endless chains 130 are maintained relatively constant along the upper portion, so that a continuous infeed of product 10 is maintained at the top of conveyor 30. During oscillation, the actual speed at which endless chains 130 move is significantly increased, to provide a continuous infeed at the top of conveyor 30. Once transfer conveyor 30 is returned to its first position, endless chains 130 are driven in synchronization with the transfer wheel 24 until the next group of products 10 is ready to be loaded.

While this invention has been described as having a preferred design, it is understood that the invention is capable of further modifications, uses, and/or adaptations which follow in general the principle of the invention and includes such departures from the present disclosure as come within known or customary practice in the art to which the invention pertains and that may be applied to the central features hereinbefore set forth and fall within the scope and the limits of the appended claims:

We claim:

1. A loading head for loading food articles into packaging, comprising:

a) a transfer conveyor in operable communication with a source of articles to be loaded and for communicating the articles from an upper receiving position to a lower loading position;

b) a first drive for driving said transfer conveyor at a variable speed;

c) a second drive oscillating said transfer conveyor between a first position and a second position;

d) a controller in operable association with said first and second drives for varying the speed of said transfer conveyor as a function of the instantaneous speed of said transfer conveyor; and e) an article holder at said loading position for receipt of a transferred article.

2. The loading head of claim 1, further comprising:

a) a transfer wheel interposed between the source and said transfer conveyor for transferring predefined sets of articles onto said transfer conveyor; and b) a third drive for driving said transfer wheel.

3. The loading head of claim 2, wherein:

a) said transfer wheel is disposed above said transfer conveyor.

4. The loading head of claim 2, wherein:

a) said transfer wheel comprises at least two transfer members, said transfer members spaced a distance sufficient to support an article and each transfer member having a plurality of outwardly extending fingers defining a plurality of pockets.

5. The loading head of claim 4, wherein:

a) there are at least two transfer wheels and the members of each wheel have an equal number of fingers; and b) said wheels are rotated about a common axis.

6. The loading head of claim 2, wherein:

a) said first, second, and third drives are driven by an electric motor.

7. The loading head of claim 4, further comprising:

a) a sweeper device in operable communication with said transfer wheel for grouping the articles into predefined sets.

8. The loading head of claim 7, wherein:

a) said sweeper device is disposed above said transfer wheel.

9. The loading head of claim 7, wherein:

a) said sweeper device comprises at least two spaced sweeper members; and b) each said sweeper member including a plurality of spaced outwardly extending fingers defining a plurality of pockets therebetween.

10. The loading head of claim 9, wherein:

a) there are at least two sweeper devices, and the members of each sweeper device have an equal number of fingers; and b) said members are rotated about a common axis.

11. The loading head of claim 9, wherein:

a) the pockets of said sweeper device are substantially equal in size to the pockets of said transfer wheel.

12. The loading head of claim 7, wherein:

a) said transfer conveyor and said sweeper device rotate in a first direction about parallel axes; and b) said transfer wheel rotates in a direction opposite to said first direction.

13. The loading head of claim 4, wherein:

a) said transfer conveyor comprises at least two spaced endless chains.

14. The loading head of claim 13, wherein:

a) each said chain includes a plurality of outwardly extending lugs defining a plurality of pockets therebetween.

15. The loading head of claim 14, wherein:

a) said chains are driven about common axes.

16. The loading head of claim 14, wherein:

a) the pockets of said transfer conveyor are substantially equal in size to the pockets of said transfer wheel.

17. The loading head of claim 1, further comprising:

a) a stripper device for intermittently discharging articles from said article holder.

18. The loading head of claim 17, wherein:

a) said stripper device includes at least a first horizontally disposed foot engageable with the food articles.

19. The loading head of claim 17, wherein:

a) a cam is in operative engagement with said stripper device for causing operation of said stripper device.

20. The loading head of claim 19, wherein:

a) said second drive comprises a rotatable eccentric in operative engagement with said transfer conveyor for oscillating said transfer conveyor between said first position and said second position.

21. The loading head of claim 20, wherein;

a) said cam and said eccentric are secured to a common shaft and rotate about a common axis.

22. The loading head of claim 20, wherein:

a) said controller includes a chain rotating at a constant velocity, and a movable drive operably engaged with said chain and said conveyor so that movement of said drive causes the first drive to be adjusted.

23. The loading head of claim 20, wherein:

a) said article holder comprises at least two spaced hinged gates; and b) said stripper device comprises at least two horizontally disposed stripper feet, each said foot associated with one of said gates and spanning a distance substantially equal to a length of said gates.

24. The loading head of claim 17, wherein:

a) said stripper device is operably associated with a single revolution clutch for controlling movement of said stripper device.

25. The loading head of claim 22, wherein:

a) said movable drive includes a first sprocket meshingly engaged with said chain; and b) said movable drive includes a second sprocket operably engaged with said conveyor.

26. The loading head of claim 25, wherein:

a) said second sprocket is disposed between and movable with first and second idler gears carried by said conveyor.

27. A loading head for loading food articles, comprising:

a) an intermediate conveyor for transferring food articles from a source;

b) a transfer wheel in operable communication with said intermediate conveyor for receiving the articles.

c) a transfer conveyor in operable communication with said transfer wheel for receiving the articles from said transfer wheel and for communicating the articles to a loading position;

d) a first drive for driving said transfer conveyor at a variable speed;

e) a second drive oscillating said transfer conveyor between a first position and a loading position;

f) a controller in operable association with said first and second drives for varying the speed of said first drive and thus of said transfer conveyor as a function of the instantaneous speed of said transfer conveyor;

g) an article holder at the loading position for receipt of a transferred article; and h) an intermittently operated stripper device for removing articles from said article holder.

28. The loading head of claim 27, wherein:

a) said transfer wheel is disposed above said transfer conveyor; and b) said transfer wheel comprises at least two spaced transfer members, each said transfer member including a plurality of spaced, outwardly extending fingers defining a plurality of pockets therebetween.

29. The loading head of claim 28, further comprising:

a) a sweeper device in operable association with said transfer wheel for grouping the articles into predefined sets and for transferring the sets to said transfer wheel.

30. The loading head of claim 29, wherein:

a) said sweeper device is disposed above said transfer wheel;

b) said sweeper device comprises at least two spaced sweeper members; and c) each said sweeper member including a plurality of spaced, outwardly extending fingers defining a plurality of pockets therebetween.

31. The loading head of claim 30, wherein:

a) said transfer conveyor and said sweeper device rotate in a first direction about parallel axes; and b) said transfer wheel rotates in a direction opposite to said first direction.

32. The loading head of claim 27, wherein:

a) said transfer conveyor includes at least two chains, each said chain including a plurality of outwardly extending lugs defining therebetween a plurality of pockets.

33. The loading head of claim 27, wherein:

a) said controller includes a chain rotating at a constant speed, and a sprocket meshingly engaged with said chain and operably connected to said conveyor.

34. The loading head of claim 33, wherein:

a) said sprocket is secured to and moves with said transfer conveyor.

35. The loading head of claim 27, further comprising:

a) a stripper device for intermittently discharging articles from said article holder.

36. The loading head of claim 35, wherein: a) an independent drive is operably connected to said stripper device for operating said stripper device independent of the speed at which the intermediate conveyor is operating.

37. The loading head of claim 27, wherein:

a) said second drive comprises a rotatable eccentric in operative engagement with said transfer conveyor for oscillating said conveyor between said first position and said second positions.

38. The loading head of claim 27, wherein:

a) said article holder comprises at least two spaced hinged gates.

39. The loading head of claim 36, wherein:

a) a single revolution clutch is operably associated with said stripper device for controlling movement of said stripper device.

40. A method for loading food articles for packaging, comprising the steps of:

a) transferring a source of food articles onto a continuously driven transfer conveyor and moving the articles from a receive position to a load position;

b) oscillating the transfer conveyor between a first position and a second, and varying the driving speed of the transfer conveyor as a function of the instantaneous speed of the transfer conveyor; and c) discharging the food articles from the transfer conveyor at the loading position.

41. The method of claim 40, including the step of:

a) grouping the food articles into predefined sets before transferring the articles onto the transfer conveyor.

42. A method for loading food articles for packaging, comprising the steps of:

a) supplying at a constant instantaneous speed a source of food articles onto a continuously driven transfer conveyor and moving the articles from a receive position to a load position;

b) oscillating the transfer conveyor between a first position and a second, and varying the driving speed of the transfer conveyor as a function of the rate of the transfer conveyor;

c) discharging the food articles from the transfer conveyor at the loading position onto a holding surface; and d) stripping the food articles from the holding surface at a constant speed and uniform force independent of the rate at which food articles are supplied from the source.

* * * * *